United States Patent [19]

Baffico

[11] 3,995,325

[45] Dec. 7, 1976

[54] MOISTURE COLLECTOR FOR TOILET

[76] Inventor: Ann L. Baffico, 168 Arbor Lane, San Mateo, Calif. 94403

[22] Filed: Sept. 9, 1975

[21] Appl. No.: 611,745

[52] U.S. Cl. ..... 4/1; 4/252 A; 4/DIG. 5

[51] Int. Cl.[2] ..... A47K 17/00

[58] Field of Search ..... 4/1, 252 A, DIG. 5

[56] References Cited

UNITED STATES PATENTS

| | | | |
|---|---|---|---|
| 2,451,714 | 10/1948 | Buffham | 4/252 A |
| 3,408,661 | 11/1968 | Hammond | 4/1 |

*Primary Examiner*—Steven L. Stephan
*Attorney, Agent, or Firm*—Townsend and Townsend

[57] ABSTRACT

An absorbent band for releasable attachment to the upper side and front marginal portions of a toilet bowl for receiving and absorbing moisture striking the toilet and tending to flow downwardly from the upper margin thereof. The band hugs the upper margin of the toilet bowl and extends from two rear extremities and forwardly about the sides and front of the bowl. A second absorbent band is utilized with the first-mentioned band and extends across the flat, upper rear surface portion of a toilet, generally ahead of the holes for receiving the bolts for fastening a toilet seat to the toilet. Several embodiments of the band are disclosed.

10 Claims, 6 Drawing Figures

MOISTURE COLLECTOR FOR TOILET

This invention relates to improvements in techniques for keeping toilet areas sanitary and, more particularly, to absorbent band structure for collecting moisture which is directed onto a toilet and tends to gravitate downwardly toward the base along the front and rear sides thereof.

BACKGROUND OF THE INVENTION

When a standard toilet is used as a urinal by a young boy standing adjacent to the toilet, it oftentimes creates an unsanitary condition because the boy often times urinates on the top upper sides or front of the toilet bowl, causing urine to pass over the top, downwardly along the sides of the toilet bowl and onto the floor adjacent to the base of the toilet bowl. This creates an unsightly appearance and odor, thereby requiring frequent cleanings of the floor and of the sides of the toilet bowl itself Attempts in the past to avoid such a situation have been to provide a mat or absorbent rug-like member adjacent to the base of the toilet. This has been successful only in absorbing the urine which settles or gravitates to the floor; however, it does not eliminate the problem due to the presence of urine on the sides of the toilet bowl which also contributes to the unsanitary conditions mentioned above.

Attempts have been made also to provide decorative shells or covers for the sides of a toilet bowl. The purpose of structures of this nature have been to improve the aesthetic appearance of a toilet, not to intercept urine as it gravitates along the sides of a toilet. Typical of the disclosures of such shell-like structures include U.S. Pat. Nos. 3,085,611 and 3,408,661.

Until now, there has been no attempt to collect or absorb urine in the vicinity near the top margin of a toilet so that it does not create the unsanitary conditions mentioned above. A need has, therefore, arisen for a moisture collector of this type and especially one which can be made disposable or one which can be made washable for reuse.

SUMMARY OF THE INVENTION

The present invention is directed to a moisture collector for releasable attachment to the upper margin of a standard toilet bowl. The moisture collector is adapted thus for intercepting urine or other moisture when the toilet seat of the toilet is in the up position. Such moisture is collected and absorbed as it gravitates from the top of the toilet and starts downwardly toward its base; thus, the collected urine is stopped at the upper margin of the toilet bowl before it has a chance to run the full height of the toilet bowl. This avoids not only urine collection at the base of the toilet but also prevents staining of the sides of the toilet bowl with urine which further contributes to an unsightly appearance and a source of undesired odors.

The present invention takes the form of an absorbent band which extends from one rear corner of a standard toilet forwardly and about the upper side and front marginal portions of the toilet, then rearwardly to the opposite rear corner of the toilet. The invention further contemplates the use of a second absorbent band for placement over the rear flat portion of the toilet, typically forwardly of the holes through the toilet bowl for receiving bolts which attach a toilet seat thereto.

Both bands are provided with means for releasably attaching the same to the toilet bowl. A suitable attachment means can be a number of double-backed adhesive members which are disposable. Moreover, the bands themselves may be disposable, such as being formed from absorbent paper of one or more layers. In the alternative, the bands can be of a washable material, such as a fabric which may or may not contain an absorbent filler material, such as plastic foam or the like. If the bands are disposable, they can be supplied in roll form and cut to the desired lengths and applied by suitable fasteners to a toilet at the desired locations. The bands can be provided in different colors or have designs thereon to enhance the aesthetic appearance of the toilet bowl itself when the bands are mounted thereon.

The primary object of this invention is, therefore, to provide a moisture collector for releasable attachment or placement to the upper margin of a toilet bowl to intercept and absorb moisture, such as urine, which falls on or collects on the top of the toilet bowl and tends to gravitate along the outside of the bowl toward the base thereof.

Another object of this invention is to provide a moisture collector of the type described which includes a first, relatively long band of absorbent material releasably secured to the upper margin of the sides and front of a toilet bowl and a second, relatively short band for releasable attachment to the rear upper flat portion of a toilet bowl so that the bands are in positions to collect substantially all moisture which falls onto the upper part of a toilet bowl to thereby prevent the moisture from gravitating to the base of the bowl.

Other objects of this invention will become apparent as the following specification progresses, reference being had to the accompanying drawing for illustrations of several embodiments of the invention. In the drawing.

Figure 1:
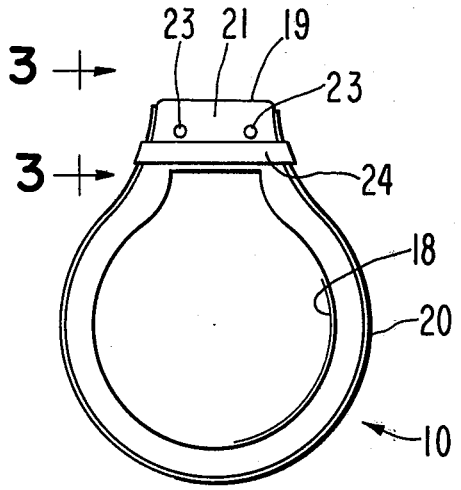
FIG. 1 is a top plan view of a conventional toilet of the type utilizing the present invention.

The absorbent moisture collector of this invention is adapted to be utilized with a conventional toilet 10 having a base 12 provided with a bowl 14 having an upper margin 16 surrounding an open top 18 which can be covered with a standard toilet seat (not shown). The rear portion 19 of toilet 10 has a flat upper surface 21 provided with two holes 23 therethrough for receiving bolts for attaching a toilet seat to the toilet as is well-known.

Figure 2:
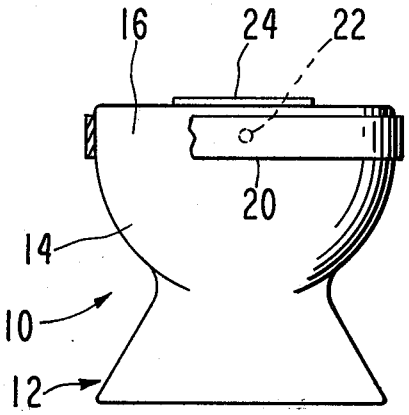
FIG. 2 is a front elevational view of the toilet of FIG. 1 with the invention being partially broken away to illustrate details of construction.
Figure 3:
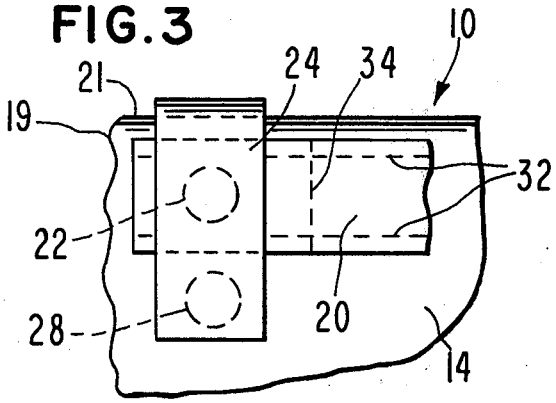
FIG. 3 is an enlarged fragmentary, side elevational view of the toilet showing the invention mounted thereon.

The present invention includes an absorbent, relatively long band 20 for placement along and about upper margin 16 of bowl 14 in a position to collect moisture which moves over the top of the bowl and starts down the side of the same. Band 20 is secured in any suitable manner about upper margin 16 (FIGS. 1 and 2) such as by a double-backed adhesive member 22 (FIGS. 2 and 3) at any one of a number of spaced locations along the length of band 20, including locations near the ends of the band. As shown in FIG. 2, one member 22 is at the front of bowl 14 and, as shown in FIG. 3, a second member 22 is adjacent one end of band 20. One or more additional members 22 can be provided at locations between members 22 of FIGS. 2 and 3 to assure that the band 20 hugs or remains contiguous to upper margin 16 as shown in FIGS. 1 and 2. Thus, the band is in a position so that any moisture contacting the upper rim or edge of the bowl and moving down the side of the bowl will be absorbed by band 20 immediately so that there will be no running of the moisture downwardly toward the base 12 and onto the floor therebelow.

Another way to secure the ends of band 20 in place is to provide it with end loops which can be looped over the projecting portions of the bolts which extend through holes 23. In such a case, it still may be desirable to use double-backed adhesive members 22 at intermediate locations along the length of band 20 so as to assure that the band hugs upper margin 16.

In addition to band 20, there is provided an additional absorbent, relatively short band 24 which is adapted to be placed on upper surface 21 of bowl 14 preferably ahead of holes 23 as shown in FIGS. 1 and 3 because bands 20 and 24 are most efficient for use when the toilet seat is in the up position. However, a third band can be provided rearwardly of holes 23 to cooperate with band 24 if considered necessary.

Band 24 is held to toilet 10 by one or more double-backed adhesive members 28 as shown in FIG. 3. Generally, the length of band 24 will be such that the ends of band 24 will be below band 20 as shown in FIG. 3 when bands 20 and 24 are mounted in respective, operative positions on toilet 10. Moreover, the width of band 24 is such as to cover at least the major portion of surface 21 forwardly of holes 23.

Figure 4:
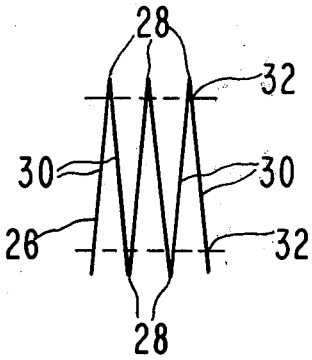
FIG. 4 is an expanded, schematic view of one embodiment of the band forming the present invention.

Typically, the width of band 20 will be two inches but it can be of other widths as desired. Both bands 20 and 24 are of absorbent material, such as paper, plastic foam or other such material. One embodiment is shown in FIG. 4 wherein band 20 is comprised of a paper sheet 26 which is folded at locations 28 to provide an accordion-like effect and to provide several layers 30 which are stacked upon each other and are interconnected at the side margins, such as by two lines of stitching 32. Paper suitable for this construction is the type used for paper towels for kitchen use. Moreover, additional transverse lines of stitching 34 can be provided to assure that the layers 30 will remain coupled together notwithstanding relatively long length of band 20. To this end, the band can come in the form of a roll and the roll can be cut to a specific length to form band 20 for the desired linear distance along margin 16. Also, band 24 can be cut from the same roll. This allows for disposing of band 20 and 24 after a certain period of use, whereupon they can be replaced by clean bands 20 and 24, the only necessity being the addition of double-backed adhesive members 22 and 28 for attaching the bands to the toilet.

The absorbent bands 20 and 24 can be made very cheaply and, when supplied in roll form or other forms, are easily packaged for marketing. Moreover, the bands can be in colors and designs can be placed on the bands by printing processes during the manufacture of the bands to add to the decorative appearance when the bands are mounted in place. The bands can be readily removed from the toilet and replaced by other, clean bands as desired or needed.

Figure 5:
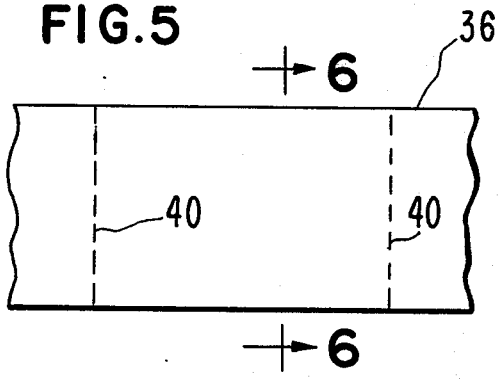
FIG. 5 is an enlarged, side elevational view of another form of the band.
Figure 6:
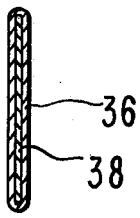
FIG. 6 is a cross-sectional view taken along lines 6—6 of FIG. 5.

Another form of the band is illustrated in FIGS. 5 and 6 and includes a tubular, body 36 which can be formed from paper, fabric or the like folded at two locations to form the side margins of the band. For purposes of illustration, FIG. 6 shows that body 36 is closed and is provided with a central filler sheet 38 of absorbent material, such as fabric, gauze, plastic foam, paper or the like. A plurality of transverse stitch lines 40 can be provided along the length of body 36 for the same reasons as stitching lines 34 of bands 20 and 24. Also, body 36 can be made in relatively long lengths and cut off to form bands 20 and 24. The body can be in the form of a roll which can be merchandized in a package so that the user can trim off the necessary lengths as new bands 20 and 24 are needed or desired.

While the foregoing has been described with respect to the disposal of bands 20 and 24 after thay have been used for a period of time, it is possible to make bands 20 and 24 of fabric which is washable so that they can be used over and over again. They can be made from suitable absorbent cloth, such as cotton, terry cloth and the like so that they can withstand frequent washings without their shape, namely that of a relatively thin band which is flexible enough to be wrapped along side margin 16 as shown in FIGS. 1 and 2. Moreover, other fasteners besides double-backed adhesive fasteners 22 and 28 can be used if desired. As an additional features, bands 20 and 24 can be scented either by the user or by the manufacturer to serve as a freshener for the area in and around the toilet 10.

I claim:

1. A moisture collector for the upper margin of a toilet comprising: a first absorbent band having an absorbent surface and a width less than the height of a toilet; means coupled with the first band for releasably attaching the same in a first operative position to the toilet with the absorbent surface extending along and engaging the upper side and front marginal portions of the toilet; a second absorbent band having an absorbent surface; and means on the second band for releasably attaching the same in a second operative position to the toilet with the absorbent surface of the second band extending across and engaging the rear flat upper portion of the toilet, the attaching means of each band having a size sufficient to assure that at least a major part of the absorbent surface of the band is in direct contact with the respective portion or portions of the toilet, the ends of the second band being adjacent to the respective ends of the first mentioned band when the bands are mounted in said operative positions on the toilet so that the band will be in a position to intercept and absorb moisture directed toward or along the respective portion or portions.

2. A moisture collector as set forth in claim 1, wherein the mounting means for at least one of the bands comprises a plurality of double-backed adhesive members adapted to engage a toilet at a number of spaced locations along the upper margin thereof, the area of each member being a number of times less than the area of the toilet-engaging surface of said one band.

3. A moisture collector as set forth in claim 1, wherein the toilet has a pair of spaced rear extremities, the length of the first band being sufficient to allow it to extend forwardly from one of said rear extremities, along one upper side marginal portion of the toilet, about the upper front marginal portion thereof, then along the other upper side marginal portion to the other rear extremity.

4. A moisture collector as set forth in claim 1, wherein the attaching means of each band includes a loop at each end, respectively, of the band, the loops adapted to be placed over the seat bolts of the toilet.

5. A moisture collector as set forth in claim 1, wherein the ends of the second band contact respective ends of the first mentioned band when the bands are mounted in said operative positions on the toilet.

6. A moisture collector as set forth in claim 1, wherein the band is formed of paper.

7. A moisture collector as set forth in claim 6, wherein the band is formed of a plurality of paper layers arranged in stacked relationship, and means maintaining the layers in said relationship.

8. A moisture collector as set forth in claim 1, wherein the band is formed of a washable fabric material.

9. A moisture collector as set forth in claim 8, wherein the band is tubular and provided with an absorbent filler.

10. A moisture collector as set forth in claim 1, wherein the width of said first band is approximately 2-inches.

* * * * *